United States Patent [19]

Van Engeland et al.

[11] 3,933,665

[45] Jan. 20, 1976

[54] MANUFACTURE OF AN ELECTROSTATIC TONER MATERIAL

[75] Inventors: Jozef Leonard Van Engeland, St. Katelijne-Waver; Noël Jozef De Volder, Edegem; Daniël Maurice Timmerman, Mortsel, all of Belgium

[73] Assignee: AGFA-GEVAERT N.V., Mortsel, Belgium

[22] Filed: Jan. 18, 1974

[21] Appl. No.: 434,686

Related U.S. Application Data

[63] Continuation-in-part of Ser. No. 162,303, July 13, 1971, abandoned.

[30] Foreign Application Priority Data

June 8, 1971 United Kingdom ..... 61855/71

[52] U.S. Cl. ..... 252/62.1 P; 96/15 D; 427/20; 260/876 R

[51] Int. Cl.[2] ..... G03G 9/00

[58] Field of Search ..... 96/15 D; 252/62.1; 260/876 R

[56] References Cited

UNITED STATES PATENTS

| | | | |
|---|---|---|---|
| 2,892,794 | 6/1959 | Insalaco | 252/62.1 |
| 2,940,934 | 6/1960 | Carlson | 252/62.1 |
| 3,391,082 | 7/1968 | McClay | 252/62.1 |

*Primary Examiner*—Charles L. Bowers, Jr.
*Assistant Examiner*—John L. Goodrow
*Attorney, Agent, or Firm*—William J. Daniel

[57] ABSTRACT

An electrostatic toner material for use in electrophotography consisting essentially of finely divided particles formed of a generally uniform mixture comprised of 5 to 15 % by weight of a colored material and 95 to 85 % by weight of resin mixture consisting essentially of:

A. 40 to 60 % by weight of a polymer having at least 50% of the recurring units thereof constituted by at least one styrene monomer of the formula:

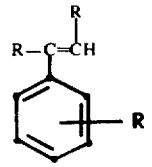

wherein R is hydrogen or methyl, and the balance of such recurring units derived from at least one alkyl methacrylate monomer wherein alkyl comprises 1–4 carbon atoms, B. 20 to 40 % by weight of a homopolymer of butyl acrylate or butyl methacrylate, or copolymers thereof with up to 80 % by weight of methyl acrylate or methyl methacrylate, and C. 5 to 20 % by weight of a polymeric plasticizer selected from polyvinyl butyral, polyethylene and co(vinyl acetate/ethylene).

The electrostatic toner material consists of particles having a diameter between 1 and 30 microns.

8 Claims, No Drawings

MANUFACTURE OF AN ELECTROSTATIC TONER MATERIAL

The invention relates to the manufacture of an electrostatic toner material and to the electrostatic toner material thus obtained, the application being a continuation-in-part application of United States Patent Application Ser. No. 162,303 filed July 13, 1971 now abandoned.

It is known to convert latent electrostatic images into visible images by means of a toner consisting of minute particles of a material, usually a resin, which mostly is coloured and which has specific triboelectric properties. Depending on the sign of the electrostatic charge the resin particles are either attracted and deposited on the charged areas of the latent image, or are repelled by the charged areas and deposited on the discharged places. Such an operation is called development of the latent electrostatic image. The latent image itself can be formed according to known techniques, e.g. by exposure of a uniformly electrostatically charged photoconducting surface containing as photoconductor zinc oxide, selenium, or an organic photoconductor.

For a better control of the development of the latent image the toner is used in combination with solid carrier particles or the toner particles can be dispersed in an insulating liquid.

If a dry developer is used, it is composed of two components, a finely ground pigmented or coloured resinous toner and a relatively coarse-grained carrier material having particle diameters of about 0.3 to 1.0 mm. For the development of the latent image, the developing mixture is cascaded merely over the exposed plate. The carrier material, e.g., glass or steel beads, which may be enveloped by a resinous film-forming product, carries the toner as it cascades over the plate and also charges the toner particles to the correct polarity by frictional electrification. As a toner-laden carrier particle passes over an electrical discontinuity in the surface of the plate, the toner particles are deposited on the charged areas of the image, not on the discharged portions or background portions of the image. Moreover, toner particles that would deposit on the background portions of the image, are taken away by following carrier particles running over the plate. This results in an image of toner particles electrostatically attracted by the image surface. This powder image can be fixed on the photoconductive plate or can be transferred to a receptor surface, e.g. a paper sheet. The transfer can be accomplished by bringing the powder image in contact with the receptor surface, if necessary, in the presence of an electrostatic field. If the receptor surface, e.g. the paper sheet, is stripped then from the image-carrying surface, it carries with it a substantial amount of toner particles in the form of the desired image. Subsequently, this image can be made permanent, i.e. fixed, according to any desired method such as heating or solvent fixing.

The photographic and physical properties of the toner should be as favourable as possible. The selection of the binding agent used in the toner material is determined especially by its triboelectrical properties. Indeed, the binding agent should allow the toner to obtain a sign of charge opposite to that of the sign of the photoconductor and of the carrier. In the case of a selenium drum positively charged by a corona discharge the most appropriate binding agents for the toner are polystyrene and polymers of styrene homologues, copolymers of styrene and acrylates or methacrylates, colophony, and esters of colophony with polyalcohols. The choice of the binding agent is also determined by physical properties. The melting point should be chosen so that the properties of the toner are not altered at normal working temperatures. On the other hand the toner should be capable of being fixed by heat whereas the paper to which the toner image has been transferred should not be scorched thereby. The melting range of the toner should preferably vary therefore between 80° and 140°C, more preferably between 110° and 120°C, whereby the actual melting range of the toner should be as narrow as possible for a fast and complete fixing of the powder image in the developing apparatus. The above-mentioned binding agents can be made appropriate especially by adaptation of the molecular weight. If the melting point is too high it can be lowered by the addition to the toner of plasticizers, e.g. compounds of the ester type such as dibutyl phthalate, triphenyl phosphate, or by the addition of low molecular weight polyethylene or of polymeric plasticizers such as e.g. polyvinyl acetals. The brittleness of the toner should be low also. Indeed, too high a brittleness would result in the soiling of the selenium drum, thus causing image fog and soiling of the apparatus in consequence of dust formation.

The toner should have appropriate plasticity characteristics. In the development zone the toner particles collide continuously. These collisions should not give rise to a change in the triboelectrical and physical properties of the toner. This can only be accomplished if the toner is a sufficiently elastic or resilient toner, i.e. if the toner under the influence of pressure can undergo a certain deformation, but immediately upon elimination of the cause assumes its original condition again. It has been found that a capacity to undergo a deformation of about 10–20% is an optimum or target range, relative to a zero deformation value for a particle which was hard or brittle. At the same time, the particles should ideally exhibit a capacity to recover from such deformation substantially completely upon removal of the deforming force. Hence, an elasticity, or recovery from deformation, should ideally be as close to 100% as possible since this tends to avoid any smearing of the toner particles on the support which would contribute to an increase of fogging during development. Compounds that can be used successfully in a toner to impart very good elactic properties are e.g. polyvinyl butyraldehyde acetal, polyethylene, and copolymers such as co(vinyl acetate/ethylene).

It is an object of the invention to manufacture an electrostatic toner material having excellent triboelectric and physical properties.

According to the invention an electrostatic toner material is provided consisting essentially of finely divided particles, comprising, based on the total weight of toner material, 5 to 15% of a colouring material and 95 to 85 % of a resin mixture comprising:

A. 40 to 60 % by weight of a polymer or copolymer comprising recurring units deriving from at least one styrene according to the formula:

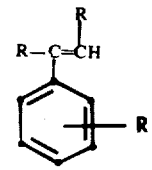

wherein:

R is hydrogen or methyl,

B. 20 to 40 % by weight of a polymer taken from the group consisting of homopolymers of butyl acrylate or methacrylate and copolymers of butyl acrylate or methacrylate with methyl acrylate or methacrylate containing up to 80 % by weight of methyl acrylate or methacrylate, and C. 5 to 20 % by weight of a polymeric thermoplastic plasticizer selected from polyvinyl butyral, polyethylene and co(vinyl acetate/ethylene), the percentages of (A), (B) and (C) being calculated on the total weight of said resin mixture, said electrostatic toner material consisting of particles having a diameter between 1 and 30 microns.

The invention also consists of an electrophotographic process wherein an electrostatic image is made visible by bringing an image surface carrying an electrostatic image in contact with toner particles consisting essentially of finelydivided particles comprising, based on the total weight of toner, between 5 and 15 % of a colouring material and 95 to 85% of a resin mixture comprising:

A. 40 to 60 % by weight of a polymer or copolymer comprising recurring units deriving from at least one styrene according to the formula:

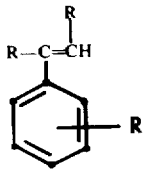

wherein:

R is hydrogen or methyl,

B. 20 to 40 % by weight of a polymer taken from the group consisting of homopolymers of butyl acrylate or methacrylate and copolymers of butyl acrylate or methacrylate with methyl acrylate or methacrylate containing up to 80 % by weight of methyl acrylate or methacrylate, and C. 5 to 20 % by weight of a polymeric thermoplastic plasticizer selected from polyvinyl butyral, polyethylene and co(vinyl acetate/ethylene), the percentages of (A), (B) and (C) being calculated on the total weight of said resin mixture, said electrostatic toner material consisting of particles having a diameter between 1 and 30 microns.

The colouring material (pigment or dyestuff) is to be present in the toner in an amount sufficient to colour the toner intensively, so that a clearly visible image is obtained. Usually the pigment is a black pigment, e.g. carbon black. In cases wherein a colour copy is desired, organic pigments or dyestuffs can be used. Normally, the amount of colouring material is comprised between 5 and 15 % by weight with respect to the total weight of the toner mass. The polymer composition is mixed with the colouring material preferably by ball-milling.

The colouring material is mixed intimately with 95 to 85% by weight, (calculated on the total weight of toner) of a mixture of resins. The first of these resins is a polymer or copolymer comprising recurring units deriving from at least one styrene according to the formula:

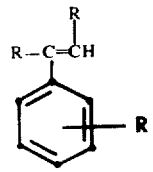

wherein:

R is hydrogen or methyl.

In a most preferred embodiment of the invention the first resin is a copolymer comprising 50 to 60 % by weight of recurring units deriving from at least one styrene compound according to the above formula, e.g. styrene together with a minor amount of α-methyl styrene, and 50 to 40 % by weight of recurring units deriving from at least one alkyl methacrylate, wherein the alkyl group comprises 1 to 4 carbon atoms. Methyl-, ethyl-, n-propyl-, iso-propyl-, n-butyl-, and isobutyl methacrylate and mixtures of these can be used. When copolymerizing e.g. styrene, α-methyl styrene and an alkyl methacrylate, normally the copolymer formed contains also a minor amount, mostly less than about 1 % by weight of units containing free carboxyl groups, probably resulting from a saponification reaction occurring during polymerization.

The copolymer of alkyl methacrylate and styrene is mixed with 20 to 40 % (calculated on the total weight of the resin mixture) of a polymer taken from the group of homopolymers of butyl acrylate or methacrylate and copolymers of butyl acrylate or methacrylate with methyl acrylate or methacrylate containing up to 80 % by weight of methyl acrylate or methacrylate. Preferred polymers are the homopolymers of n-butyl methacrylate and the copolymer of n-butyl methacrylate and methyl methacrylate (25:75 % by weight).

As a third component a polymeric thermoplastic plasticizer is added to the resin mixture in an amount of 5 to 20 % by weight. The plasticizer is taken from the group consisting of polyvinyl butyral, polyethylene and copolymers such as co(vinyl acetate/ethylene). When polyvinyl butyral is used the polymeric chain may comprise minor amounts of units deriving from vinyl alcohol and vinyl acetate.

The different resins can be mixed by melting. The colouring material is added to the resulting melt while stirring until a homogeneous blend is formed. After cooling, the solid mass obtained is crushed and further ground in a ball-mill to a particle size of 1 to 30 microns. The resulting powder is not tacky at room temperature so that it will freely flow over the surfaces carrying the latent electrostatic images.

For the development of the electrostatic images the toner is applied loosely to the latent electrostatic image where it is attracted electrostatically at the latent image areas. The most usual developing method is cascade development. According to this method the electrostatic toner is mixed with a granular carrier, which may be electrically conductive or insulating. The granular carrier material is composed of glass or steel beads, either or not encased in a suitable covering, which imparts the necessary triboelectric properties to the granular carrier material. Normally 1 part by weight of toner powder is mixed with about 100 parts by weight of granular carrier material.

The carrier particles, when brought in close contact with the powdery toner particles, obtain a charge of a polarity opposed to that of the toner particles, so that the latter envelop the carrier particles. If a positive reproduction of an electrostatic image is desired, the carrier is chosen in such a way that the toner particles obtain a charge with a polarity opposite to that of the electrostatic charge. In order to obtain a negative copy the carrier can be chosen in such a way that the toner particles obtain a charge having the same polarity as that of the electrostatic image.

The carrier particles have to be large enough, larger anyway than the toner particles. They have such a shape, that they roll over the image-carrying surface. Preferably glass beads are used having a diameter of 600 to 800 microns. The toner particles are attracted by the charged areas of the surface and separated from the carrier particles, which in consequence of gravity continue their rolling motion.

The toner particles are fixed on paper or any other support by heat or solvent fixing. When heat energy is supplied or solvent is added to the toner, the toner softens, tends to become more fluid, flows together and is attached irreversibly to the paper support.

The invention is illustrated by the following examples.

EXAMPLE 1

A toner mixture is prepared from 5.2 parts by weight of polystyrene having a molecular weight of approximately 30,000 and 1 part by weight of polyvinylbutyral having a molecular weight of approximately 30,000, which in addition to the vinyl butyral groups contains also approximatively 20 % by weight of vinyl alcohol groups and 2.5% by weight of vinyl acetate groups. 2.8 parts by weight of co(methyl methacrylate/n-butyl methacrylate)(50:50 mole % corresponding to a percentage by weight ratio of 39:61, and having an intrinsic viscosity of 0.2 measured in chloroform at 20°C) and 1 part by weight of Spezialschwarz IV (trade name for carbon black sold by Deutsche Gold- und Silberscheideanstalt, Frankfurt a/M, Germany) are added as well.

The components are mixed in dry condition and then melted at a temperature of 150°–160°C. The melt is then kneaded for approximately 30 min. at the same temperature. After cooling and breaking to a particle size of approximatively 1 mm the powder is ground for 15 h, in aqueous medium in a vibration ball mill. After drying and sieving a toner having a particle size of 37.5 micron with a fixing temperature of approximately 130°C is obtained.

A developer mixture is then prepared by mixing 1 g of this toner powder with 100 g of carrier particles composed of glass beads having a diameter of 600 to 800 microns.

After positively charging of a selenium drum and image-wise exposing to an original, the developing mixture was cascaded over the electrostatic latent image. A black toner image was left on the selenium drum. The image was then transferred to a paper support. The image on this paper support was fixed by heating.

In this way an image with a sufficiently high density was obtained. The image was sharp but felt rather rough. After successive developments with the same developer mixture only a very weak change in contrast was observed.

If in the above mentioned process the mixture of polystyrene, polyvinyl butyral, and co(methyl methacrylate/n-butyl methacrylate) in the toner would be replaced by pure polystyrene, images having a good density would be obtained, which would feel rather rough also. The images, however, would be unsharp and during the successive developments with the same developer mixture the fog would increase considerably and the image density, i.e. the contrast, would be reduced markedly.

If to the developer mixture of polystyrene and carbon black an amount of polyvinyl butyral as described above is added also, a slight improval with respect to fog would be found during continuous use. The other disadvantages would remain, however.

If the polyvinyl butyral would be replaced by polyisobutyl methacrylate an improval of the density would be obtained, the copy would still feel rough but during successive developments the fog would still increase.

It appears therefrom that only with the mixture according to the invention, which contains polymers of styrene, polyvinyl butyral and co(methyl methacrylate/n-butyl methacrylate) sharp, contrasty images having a good density are obtained and that during continuous use of this developer mixture no fog is formed nor that their image density diminishes.

EXAMPLE 2

A toner mixture is prepared from 5.2 parts by weight of resin A, 2.8 parts by weight of resin B, 1 part by weight of resin C and 1 part by weight of carbon black Spezialschwarz IV.

Resin A is a copolymer containing 50 % by weight of styrene, 5 % by weight of α-methyl styrene, and 45 % by weight of isobutyl methacrylate.

Resin B is a copolymer of methyl methacrylate and n-butyl methacrylate (39:61 % by weight).

Resin C is polyvinyl butyral containing approximatively 20 % by weight of vinyl alcohol groups and 2.5 % by weight of vinyl acetate groups.

This toner mixture is melted in the same way as in example 1 and ball-milled. It has a fixing temperature of approximatively 110°C.

1 g of this toner powder is mixed with 100 g of carrier particles consisting of glass beads having a diameter of 600 to 800 microns.

Image-wise exposure, development of the latent image, transfer to a paper support and fixation are performed as in example 1.

Positive images having a high density and sharpness are obtained. The fixing temperature of the powder images is in a very favourable temperature range. During successive developments with the same developer mixture only a very weak fog is obtained.

If for comparison in the above-mentioned developer mixture of resins A, B, C the two latter substances are omitted so that only a copolymer of styrene, α-methyl styrene and isobutyl methacrylate is used, we find that a lowering of the fixing temperature is obtained also and that the image shows a smooth surface. The fog during continuous use of the toner powder is very important, however.

If a developer mixture is used, which contains resin C in addition to resin A, the fixing temperature is somewhat higher and the fog value is improved as compared with resin A alone. Although the contrast obtained is better than in the case polystyrene is used alone, it is worse however, than in the case a mixture of the three resins is used.

In the above examples use is made of carrier particles consisting of simple glass beads. In order to improve the action of the carrier particles, especially at high relative humidities, e.g. at 65 % and more, the glass beads can be subjected to a special pretreatment. Therefore the glass beads having a diameter of 600 to 800 microns are degreased and treated with chromic acid. After washing with distilled water until free of acid, the beads are dried with air at approximatively 90°C. Subsequently the glass beads are rolled into a solution in cyclohexane of a trialkoxysilane according to the following structural formula:

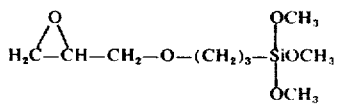

Other trialkoxysilanes that may be used are those described in our United Kingdom Patent Application No. 54,678/68.

The beads are then dried in a hot air current of approximatively 80°C and rolled into a solution of an azo dye and ethyl cellulose. Suitable solvents are e.g. tetrachloroethane, methylene chloride, 1,2-dichloroethane, toluene, xylene, or mixtures thereof, an appropriate azo dye is e.g. Zapon fast yellow R (C.I. 18,690) (trade mark of Badische Anilin- und Soda-Fabrik, Ludwigshafen, Germany).

A suitable proportion of the ingredients is e.g. 1 kg of glass beads, 0.5 g of dye, 1 g of ethyl cellulose and 25 ml of solvent.

The glass beads that have been pretreated with trialkoxysilane as described above are now surrounded by a layer of ethylcellulose and dye. After approximatively 30 min. of rolling the glass beads are dried in a hot air stream of approximatively 80°C.

As a result of the pretreatment with the trialkoxysilane the ethyl cellulose adheres very strongly to the glass beads, so that the layer after repeated use (approximatively 15,000 copies) of the developer mixture still adheres to the carrier. The treatment also reduces the fog in the toner images during continuous use.

Instead of treating the glass beads prior to the enveloping with ethyl cellulose with a trialkoxysilane they can be treated also with organic phosphor compounds, e.g. those described in the United Kingdom Patent Specification No. 1,151,141, which are bivalent or trivalent metal salts of a phosphorus oxyacid containing at least one organic residue.

EXAMPLE 3

In the toner mixture described in Example 2, the 2.8 parts of polyvinyl butyral are replaced by a same amount of co(vinyl acetate/ethylene) having an ethylene content of 72 % by weight. The toner mixture formed is melted in the same way as in Example 1 and ball-milled. It has a fixing temperature of 108°C.

After image-wise exposure, development of the latent image, transfer to a paper support, and fixation as in Example 1, positive images having a high density and sharpness are obtained. During successive developments with the same developer mixture only a very weak fog is noticed.

EXAMPLE 4

Glass beads having a diameter of 600–800 microns are degreased, treated with chromic acid, and washed with distilled water until free of acid. Thereafter the beads are dried with air at approximatively 90°C. Subsequently, the glass beads are rolled into a solution of zinc tridecylphosphate in diethyl ether. For 1 kg of glass beads 25 ml of a 5 % by weight solution of zinc tridecylphosphate in diethyl ether is used.

The glass beads are dried in air of approximatively 80°C and rolled for 30 min. in a ball-mill containing the following mixture:

| | | |
|---|---|---|
| azo dye | 0.5 | g |
| ethyl cellulose | 1 | g |
| methylene chloride | 22.5 | ml |
| 1,2-dichloroethane | 2.5 | ml |

After drying in air of 80°C glass beads are obtained that are surrounded with a layer of ethyl cellulose and an azo dye.

100 g of glass beads thus pretreated are mixed with 0.5 g of toner mixture as described in Example 2 and used as a xerographic developer. The images formed after transfer to a paper support and thermofixing have an excellent quality, even after a production of more than 10,000 copies. Even then the adhesion of the ethyl cellulose layer to the glass beads was still excellent.

EXAMPLE 5

The process of Example 2 is repeated with the difference that instead of glass beads, stell balls having a diameter of 300–400 microns and which have been surrounded with a layer of cellulose nitrate are used as the carrier material. This enveloping with cellulose nitrate is performed in a ball-mill wherein the steel balls are mixed with 4 % by weight of cellulose nitrate dissolved in methyl isobutyl ketone. The ball-mill is heated by means of an infrared lamp, so that the solvent evaporates slowly and leaves the ball-mill through an axial discharge tube.

0.5 g of the toner mixture of Example 2 is mixed with 100 g of the thus treated steel ball and the developer mixture formed is used as described in Example 1 to develop a negatively charged and image-wise exposed zinc oxide layer. The sign of charge of the toner now is positive and a sharp positive image is obtained from the original.

EXAMPLE 6

The process described in Example 2 is repeated with the difference, however, that resin B is replaced by a copolymer of methyl methacrylate and n-butyl methacrylate containing 33% by weight of methyl methacrylate and 67% by weight of n-butyl methacrylate.

Positive images having also high density and sharpness are obtained.

EXAMPLE 7

A toner mixture is prepared from 5.2 parts by weight of resin A, 2.8 parts by weight of resin B, 1 part by weight of resin C and 1 part by weight of Calco Oil black.

Resin A is a copolymer containing 56 % by weight of styrene, 7 % by weight of α-methyl styrene and 37 % by weight of isobutyl methacrylate.

Resin B is a copolymer of methyl methacrylate and n-butyl methacrylate (75:25 % by weight).

Resin C is polyvinyl butyral containing approximatively 20 % by weight of vinyl alcohol units and 2.5 % by weight of vinyl acetate units.

Calco Oil black is the trade name of carbon black powder sold by Pylam Products Co., U.S.A.

The components are mixed in dry condition, whereafter the mixture is kneeded for 30 min. at a temperature of approximatively 135°C. After cooling and breaking 60 g of the mixture is ground for 15 h in a vibration ball mill in the presence of 240 ml of water. The mass is sucked off and air dried to a moisture content of 0.5 % maximum. Sieving of the powder gives a toner having a particle size between 1 and 30 micron, with a melting temperature of approximatively 117°C. 1 g of this toner powder is mixed with 99 g of glass beads having a diameter between 600 and 800 microns. According to the cascade method, the developer mixture formed is used to produce a positive image on a negatively charged zinc oxide paper that had been image-wise exposed to light. The image on the paper is fixed by heat or solvent fixing. An image with a sufficiently high density is formed that showed little or no fog in the non-image areas.

EXAMPLE 8

An organic photoconductor layer such as described in our cognated United Kingdom Patent Applications Nos. 15,333/69 and 42,061/69 is negatively charged and thereafter image-wise exposed to light. For developing the latent image formed, the developer mixture of toner and glass beads of Example 7 is cascaded over the exposed plate. The powder image is electrostatically transferred to a piece of paper whereon it is fixed, e.g. by heat. The powder remaining on the organic photoconductor is eliminated electrostatically and mechanically, whereupon the organic photoconductor plate is immediately ready for another image-wise developing.

The image that was formed showed good line reproduction and is satisfactory solid area coverage with little background deposition.

EXAMPLE 9

Very good positive images are formed on a zinc oxide paper or on a paper containing an organic photoconductor, such as described in our cognated United Kingdom Patent Applications Nos. 15,333/69 and 42,061/69, when using a toner mixture formed according to the method described in Example 7, the ingredients of which were the same, with the sole difference, however, that instead of using Calco Oil black, a same amount of Waxoline Nigrosine NS was used, which is the trade name of a carbon black sold by Imperial chemical Industries, Great Britain.

EXAMPLE 10

The process of the first part of Example 2 was repeated with the sole difference that co(methyl-methacrylate/n-butyl methacrylate (39:61 % by weight) was replaced by a same amount of poly-n-butyl methacrylate. The fixing temperature of the toner was about 125°C. Copies made with the toner material had the following characteristics:

— high density
— sharp images
— a fixing temperature that is acceptable
— a positive image.

The toner possessed great mechanical strength which was demonstrated in a continuous process using always the same developer mixture.

We claim:

1. A particulate composition of matter adapted for developing electrostatic images consisting essentially of finely divided particles comprising by weight 5 to 15 % of a colored material and 95 to 85 % of a resin mixture consisting essentially of:

A. 40 to 60 % by weight of a polymer having about 50 % of the recurring units thereof derived from at least one styrene monomer of the formula:

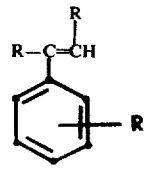

wherein:

R is hydrogen or methyl, and the balance of such recurring units derived from at least one alkyl methacrylate monomer wherein alkyl comprises 1–4 carbon atoms, B. 20 to 40 % by weight of a homopolymer of butyl acrylate or butyl methacrylate or a copolymer of butyl acrylate or butyl methacrylate with up to 80 % by weight of methyl acrylate or methyl methacrylate, and C. 5 to 20 % by weight of a polymeric plasticizer selected from polyvinyl butyral, polyethylene and co(vinylacetate/ethylene), said particles having a diameter between 1 and 30 microns.

2. A particulate composition of matter according to claim 1, wherein resin (A) is polystyrene.

3. A particulate composition of matter according to claim 1, wherein resin (A) comprises 50 to 60 % by weight of recurring units deriving from at least one styrene monomer of the formula:

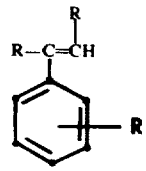

wherein:

R is hydrogen or methyl, and 50 to 40 % by weight of at least one alkyl methacrylate, wherein the alkyl group comprises 1 to 4 carbon atoms.

4. A particulate composition of matter according to claim 3, wherein resin (A) is a copolymer of styrene and isobutyl methacrylate.

5. A particulate composition of matter according to claim 3, wherein resin (A) is a copolymer of styrene, α-methyl styrene and isobutyl methacrylate.

6. A particulate composition of matter according to claim 1, wherein resin (B) is a homopolymer of n-butyl methacrylate.

7. A particulate composition of matter according to claim 1, wherein resin (B) is a copolymer of n-butyl methacrylate with up to 80 % by weight of methyl methacrylate.

8. A particulate composition of matter according to claim 1, wherein resin (B) is a copolymer of n-butyl methacrylate and methyl methacrylate in a ratio of 25-75 % by weight.

* * * * *

UNITED STATES PATENT AND TRADEMARK OFFICE

CERTIFICATE OF CORRECTION

PATENT NO. : 3,933,665

DATED : January 20, 1976

INVENTOR(S) : Jozef Leonard Van Engeland et al

It is certified that error appears in the above-identified patent and that said Letters Patent are hereby corrected as shown below:

In the heading, item [30], Foreign Application Priority Data should read:

-- Dec. 30, 1970 United Kingdom 61855/70

June 8, 1971 United Kingdom 61855/70 --.

Signed and Sealed this

Eighth Day of March 1977

[SEAL]

*Attest:*

RUTH C. MASON
*Attesting Officer*

C. MARSHALL DANN
*Commissioner of Patents and Trademarks*